United States Patent [19]

Harmelink et al.

[11] Patent Number: 5,001,910

[45] Date of Patent: Mar. 26, 1991

[54] CONTROL SYSTEM

[75] Inventors: Gregory K. Harmelink; John C. Mellinger, both of Newton, Iowa

[73] Assignee: Maytag Corporation, Newton, Iowa

[21] Appl. No.: 495,025

[22] Filed: Mar. 16, 1990

[51] Int. Cl.[5] ..... D06F 33/02; D06F 37/28

[52] U.S. Cl. ..... 68/12 R; 068/23 R; 200/61.62

[58] Field of Search ..... 68/12 R, 23 R; 134/57 DL, 58 DL; 200/61.62; 307/134, 137; 361/102, 104

[56] References Cited

U.S. PATENT DOCUMENTS

| | | | |
|---|---|---|---|
| 2,825,050 | 2/1958 | Hausten | 307/134 |
| 3,011,079 | 11/1961 | Mellinger | 68/12 R |
| 3,024,637 | 3/1962 | Hughes et al. | 68/12 R |
| 3,387,873 | 6/1968 | Prosser et al. | 68/12 R |
| 3,451,233 | 6/1969 | Shopsky | 68/12 R |
| 3,488,463 | 1/1970 | Mellinger | 200/61.76 |
| 3,590,605 | 7/1971 | Low | 68/12 R |
| 3,638,475 | 2/1972 | Filipak | 68/23 |
| 3,673,824 | 7/1972 | Ripsco et al. | 68/12 R |
| 3,699,300 | 10/1972 | Buerki | 219/10.55 |
| 3,803,881 | 4/1974 | Getz et al. | 68/12 R |
| 4,096,370 | 6/1978 | Duncan | 219/10.55 |
| 4,449,383 | 5/1984 | Cartier | 68/12 R |
| 4,455,462 | 6/1984 | DeLucia | 200/61.62 |
| 4,711,103 | 12/1987 | Mori et al. | 68/12 R |
| 4,764,648 | 8/1988 | Resh | 200/61.62 |

*Primary Examiner*—William A. Cuchlinski, Jr.
*Assistant Examiner*—B. Bennett
*Attorney, Agent, or Firm*—Richard L. Ward

[57] ABSTRACT

A control system is provided for a fabric washing machine including first and second lid actuated switches and washing fluid level detecting apparatus. A lockout device is in circuit with a conductive path of the second switch so that, if upon operation of the lid, the first switch is failed, a circuit is completed through the lockout device and level detecting apparatus to prevent reenergization of the fabric washing machine. Switch mounting apparatus is provided which is adjustably movable for providing concurrent adjustment of at least the first and second switches with respect to a lid actuated switch actuator mechanism.

24 Claims, 4 Drawing Sheets

CONTROL SYSTEM

BACKGROUND OF THE INVENTION

This invention relates generally to a control system for use with a fabric washing machine and more particularly to a control system operable for disabling the fabric washing machine if the contacts of a lid actuated switch fail in the conductive posture.

In the operation of a fabric washing machine, a lid actuated switch in circuit connection with the operating apparatus is commonly utilized. The contacts of this switch are generally closed when the lid is closed and are open when the lid is open so that operation of the fabric washing machine is normally interrupted whenever the lid is open. Thus, if the contacts of the lid actuated switch should fail in the closed posture, such as by welding, the washing machine will still be operational when the lid is open.

Prior art has shown an ongoing search for a control system through which an appliance is placed in a disabled condition if a particular switch should fail in a conductive posture when a non-conductive posture is normal. In the field of microwave ovens, for example, opening the access door will effect the opening of a pair of series connected switches so that if one switch fails in a conductive posture the other switch will be in a non-conductive posture for preventing energization of the oven with the access door open. Also shown in the field of microwave ovens are circuits where opening the access door again normally opens a pair of series connected switches. If one of these switches should fail in the conductive posture, a circuit is provided for blowing a fuse to prevent energization of the oven.

There has not been any provision of a control system in which an appliance, such as a fabric washing machine, will be disabled if the lid switch contacts fail in the conductive posture with the lid in the open position and in response to a predetermined operational condition of the fabric washing machine.

SUMMARY OF THE INVENTION

It is therefore an object of the instant invention to provide an improved control system for a fabric washing machine.

It is a further object of the instant invention to provide a control system operable for disabling the fabric washing machine when a lid switch has failed and responsive to a condition of the fabric washing machine.

It is a still further object of the instant invention to provide a control system with a lid switch mechanism including switch mounting apparatus movable for providing concurrent adjustment of at least a pair of switches with respect to a lid actuated switch operator.

Briefly, the instant invention achieves these objects in a control system for a fabric washing machine having a movable lid for providing access to a tub assembly. The control system includes a power supply and a first switch in circuit with the power supply and operable between conductive and non-conductive postures. A second switch is in circuit with the first switch and is operable between a lid-closed first conductive path and a lid-open second conductive path. Apparatus is provided for operating the first and second switches. The control system further includes a third switch responsive to a condition of operation of the fabric washing machine. A lockout is provided in circuit with the third switch and the second conductive path of the second switch for interrupting operation of the fabric washing machine and preventing reenergization thereof upon failure of the first switch to operate to the non-conductive posture.

Operation of the control system and further objects and advantages thereof will become evident as the description proceeds and from an examination of the accompanying four sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
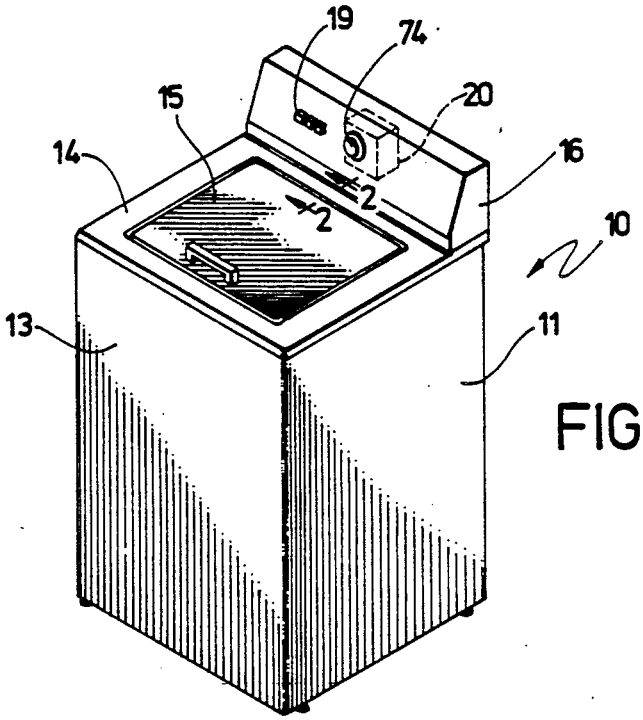
FIG. 1 is an isometric view of a fabric washing machine utilizing the control system of the instant invention.
Figure 2:
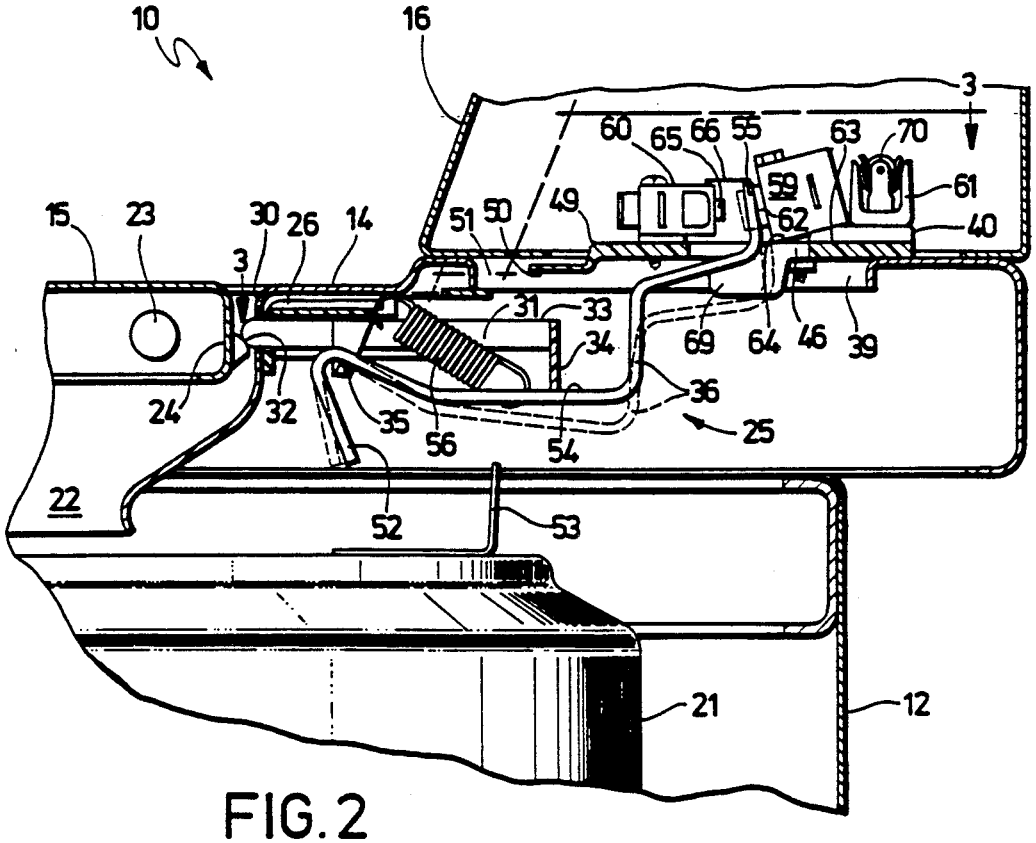
FIG. 2 is a partial fragmentary section view taken generally along lines 2—2 of FIG. 1 and showing the lid actuated switches of the instant invention.

Referring now to the drawings and to Figures 1 and 2 in particular, there is shown an automatic fabric washing machine 10. The automatic fabric washing machine 10 is housed within a generally rectangular cabinet having a three-sided enclosure forming the sides 11 and rear 12 of the cabinet. A substantially vertically oriented front panel 13 completes the peripheral cabinet of the fabric washing machine 10. The cabinet of the fabric washing machine 10 further includes a generally horizontally disposed top cover 14 incorporating a pivotable access door or lid 15 for providing access to the interior of the fabric washing machine 10. A control housing 16 extends generally upward from the rear of the top cover 14 and houses miscellaneous controls such as selection switches 19 and in this embodiment an electromechanical timer 20, shown in dashed lines in FIG. 1, for controlling the sequential operation of the fabric washing machine 10 through a plurality of events such as filling the tub 21 with washing fluid, dispensing detergent and/or bleach, agitation, washing fluid extraction, and rinsing which comprise a predetermined cycle of operations. As best shown in FIG. 2, the top cover 14 includes an access opening 22 through which fabrics may be inserted into or removed from the tub 21. The access opening 22 is closed by the access door or lid 15 which is pivoted about a fulcrum 23 spaced a short distance from the rear end 24 of the lid 15. The rear end 24 of the lid 15 functions as a lever with respect to the fulcrum 23 for engaging the switch actuating and unbalance mechanism 25.

Figure 4:
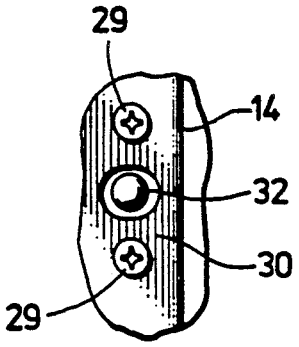
FIG. 4 is a fragmentary view taken generally along lines 4—4 of FIG. 3 showing the attachment of a frame portion of the lid actuating mechanism to the top cover of the fabric washing machine.

The switch actuating and unbalance mechanism 25 has a molded plastic frame 26 which is attached to the underside of the top cover 14 by a pair of screws 29, as best shown in FIG. 4, which extend through a substantially vertical wall 30 associated with the access opening 22 of the top cover 14 and thread into the frame 26. A plunger 31 is slidingly supported within the frame 26. The front end 32 of the plunger 31 is in the form of a projecting nose which extends generally horizontally through the vertical wall 30 associated with the access opening 22 of the top cover 14 and contacts the rear end 24 of the lid 15. The frame 26 is generally hollow and supports the plunger 31 for substantially horizontal sliding movement to the right and/or left depending on the posture of the lid 15. The rear end 33 of the plunger 31 has a downwardly extending flange 34 which contacts and slides relative to the horizontally extending portion 54 of the unbalance mechanism 25. The plunger 31 further includes an undercarriage 35 for pivotally supporting the combination unbalance lever and lid switch actuator 36 on the plunger 31 and which will be further described herein.

Figure 3:
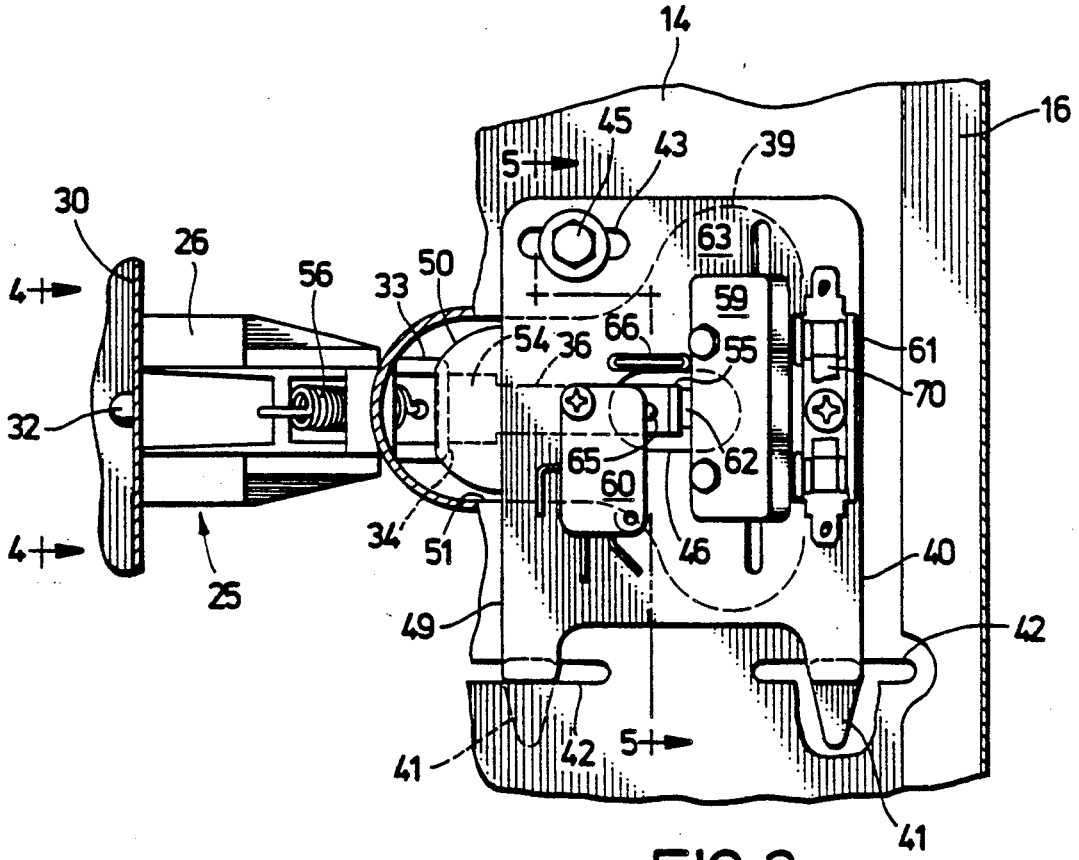
FIG. 3 is a partial fragmentary section view taken generally along lines 3—3 of FIG. 2.

As best shown in FIGS. 2 and 3, the top cover 14 has a downwardly formed generally T-shaped opening 39 spaced rearwardly from the access opening 22 and axially aligned with the switch actuating and unbalance mechanism 25. The T-shaped opening 39 is covered by the control housing 16 when it is fastened to the top cover 14. The T-shaped opening 39 serves first as a hand-hold for handling the top cover 14 during manufacturing operations and when assembled as part of the fabric washing machine 10 provides an opening between the interior of the control housing 16 and the interior of the fabric washing machine 10.

Figure 5:
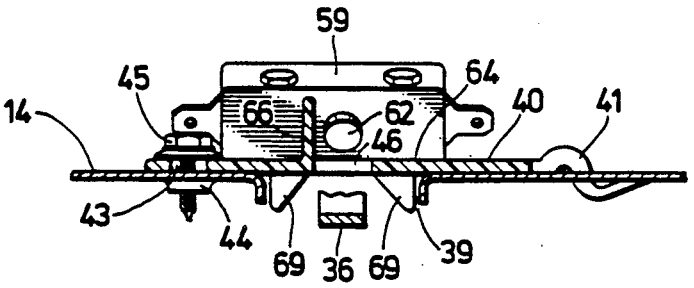
FIG. 5 is a fragmentary view taken generally along lines 5—5 of FIG. 3.

As further shown in FIGS. 2, 3, and 5, a generally rectangular switch mounting bracket 40 is secured to the top cover 14 so that it substantially overlies the T-shaped opening 39. As best shown in FIG. 3, one side of the switch mounting bracket 40 includes a pair of spaced-apart downwardly extending tabs 41 which are received by a pair of slots 42 formed in the top cover 14. The pair of slots 42 are generally parallel with the front-to-rear axis of the switch actuating and unbalance mechanism 25 and permit the switch mounting bracket 40 to move in a sliding fashion a predetermined front-to-rear distance upon the top cover 14. The opposite side of the switch mounting bracket 40 has a slot 43 which is generally parallel to the pair of slots 42 in the top cover 14. The slot 43 in the switch mounting bracket 40 overlies an extruded aperture 44 in the top cover 14, as best shown in FIG. 5, which receives a locking fastener 45 for securing the switch mounting bracket 40 to the top cover 14.

The central portion of the switch mounting bracket 40 further includes an opening 46 which is axially aligned with the front-to-rear path of the unbalance lever and lid switch actuator 36. As again shown in FIGS. 2 and 3, the forward edge 49 of the switch mounting bracket 40 has a forwardly extending tongue 50 which, as best shown in FIG. 2, rides in the narrowed front-to-rear portion 51 of the T-shaped opening 39 to reduce twisting movement of the switch mounting bracket 40 during sliding movement thereof with respect to the top cover 14. The tongue 50 substantially fills the narrowed front-to-rear portion of the T-shaped opening 39 and with the main body of the switch mounting bracket 40 provides a vapor barrier between the control housing 16 and the interior of the fabric washing machine 10.

As previously described and as shown in FIG. 2, the unbalance lever and lid switch actuator 36 is pivotally supported by the undercarriage 35 of the plunger 31 and includes a depending lever 52 extending substantially downward from the pivot connection between the unbalance lever and lid switch actuator 36 and the plunger 31. The depending lever 52 is positioned for engagement by the bumper 53 upon excessive gyration of the tub 21 to pivot the unbalance lever and lid switch actuator 36 downwardly to the dashed line posture shown in FIG. 2 for interrupting operation of the fabric washing machine 10. The unbalance lever and lid switch actuator 36 further includes a horizontally extending portion 54 having an upturned end 55 which extends angularly upward and to the right in FIG. 2 through the T-shaped opening 39 in the top cover 14 and through the opening 46 in the switch mounting bracket 40. As the access door or lid 15 is closed and opened, the unbalance lever and lid switch actuator 36 is moved a predetermined linear rearward and forward distance respectively.

A biasing spring 56 is operably disposed between the unbalance mechanism frame 26 and the unbalance lever and lid switch actuator 36. This biasing spring 56 provides upwardly and forwardly directed components of biasing force. The upwardly directed component of force maintains the horizontally extending portion 54 of the unbalance lever and lid switch actuator 36 against the rear flange 34 of the plunger 31. The forwardly directed component of force biases the unbalance lever and lid switch actuator 36 and the plunger 31 in a forward direction to maintain engagement of the nose of the plunger 31 with the rear end 24 of the access door or lid 15.

The switch mounting bracket 40 is designed to rigidly mount a pair of switches 59 and 60 and a fuse holder 61. A single-pole single-throw lid switch 59 is secured to the switch mounting bracket 40 overlying the opening 46. The actuator button 62 of the lid switch 59 is juxtaposed to the upturned end 55 of the unbalance lever and lid switch actuator 36. The lid switch 59 is mounted to the switch mounting bracket 40 with the actuator button 62 tilted at an angle with respect to the top surface 63 of the switch mounting bracket 40. The angular mounting tilts the lower front edge 64 of the lid switch 59 with respect to the upturned end 55 of the unbalance lever and lid switch actuator 36. Thus, there will be no interference with the lower front edge 64 of the lid switch 59 after an unbalance situation in which the unbalance lever and lid switch actuator 36 have been pivoted below the switch mounting bracket 40. A single-pole double-throw switch 60 is mounted forwardly of the lid switch 59 and also overlies the opening 46 in the switch mounting bracket 40. The actuator button 65 of the switch 60 is juxtaposed the opposite side of the upturned end 55 and faces the actuator button 62 of the lid switch 59.

It is noted, with respect to FIGS. 2 and 3, that the facing switch actuator buttons 62 and 65 are a fixed horizontal distance apart. As best shown in FIG. 2, the switch actuator buttons 62 and 65 are arranged at different heights with respect to the top surface 63 of the switch mounting bracket 40 to insure that the unbalance lever and lid switch actuator 36 will properly move upward between the switches 59 and 60 as the lid 15 is raised and then lowered after an unbalance situation.

As best shown in FIG. 5, an upwardly extending wall 66 is located to the left of the opening 46 for protecting the actuator buttons 62 and 65 of the switches 59 and 60 from interference with miscellaneous wires. As further shown in FIG. 5, a pair of downwardly extending guides 69 are molded alongside the opening 46 in the switch mounting bracket 40. The guides 69 are tapered towards the opening 46 in the switch mounting bracket 40 to guide the unbalance lever and lid switch actuator 36 toward the opening 46.

The switch mounting bracket 40 with the rigidly mounted switches 59 and 60 is slidable on the top cover 14 to provide for simultaneous adjustment of the switches 59 and 60 with respect to the upturned end 55 of the unbalance lever and lid switch actuator 36. In normal operation, it is desired that the lid switch 59 open first as the lid 15 is opened. Also, the lid switch 59 should be the last to close as the lid 15 is closed. Adjustment of the switch mounting bracket 40 is thus made primarily with respect to the lid switch 59. The switch mounting bracket 40 is moved with respect to the slots 42 so that there is continuity across the lid switch 59 with the correct opening between the front edge of the lid 15 and the top cover 14. In this posture, the switch 60 will be closed to contact 84 to permit operation of the fabric washing machine 10.

It is further shown in FIGS. 2 and 3 that the switch mounting bracket 40 mounts a fuse holder 61. The fuse holder 61 is conveniently positioned behind the lid switch 59 and is thus located for easy accessibility if replacement of the fuse 70 is required.

Figure 6:
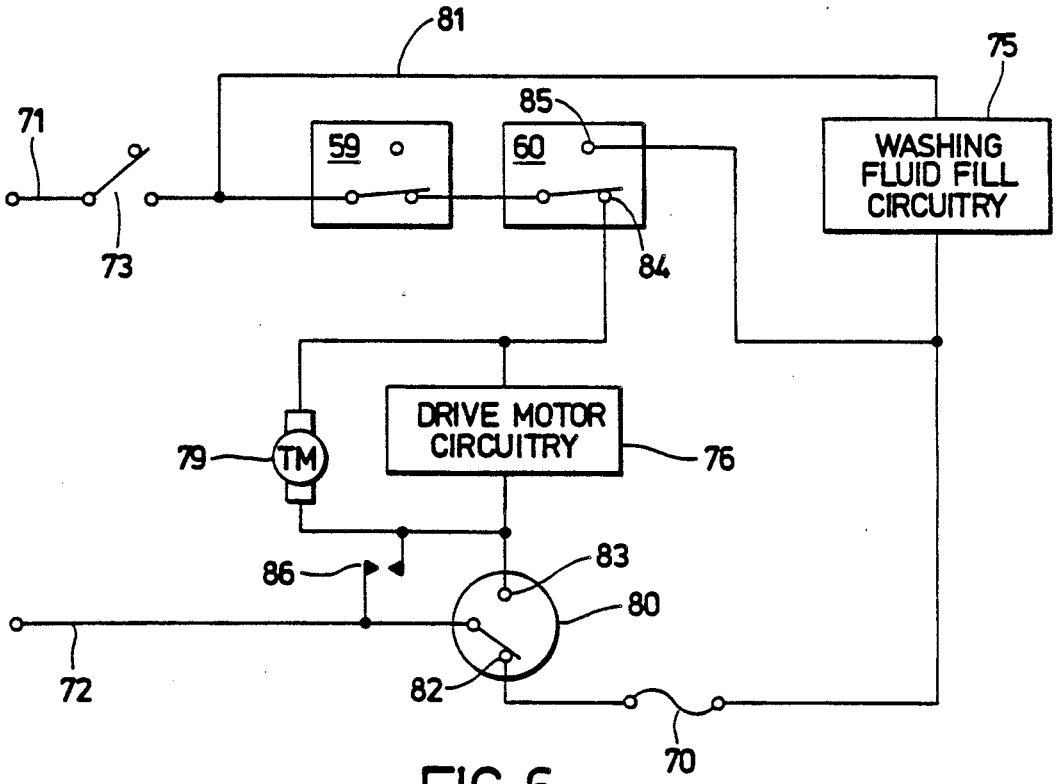
FIG. 6 is a partial electrical schematic drawing of the operational circuitry of the instant invention.

Turning now to FIG. 6, there is shown a partial schematic drawing of the lid switch circuit of the instant invention. The circuit includes a source of power as provided by standard 120 VAC between conductors 71 and 72 and commonly available in most households. A line switch 73 is incorporated in the internal circuitry of the electromechanical timer 20 and is operated by manipulating the timer control knob 74. The circuit further includes the single-pole single-throw lid switch 59, the single-pole double-throw switch 60, washing fluid fill circuitry 75, drive motor circuitry 76, a timer drive motor 79, a pressure actuated washing fluid level switch 80 and a fuse 70.

The washing fluid fill circuitry 75 shown in block form in FIG. 6 comprises hot and cold washing fluid valves, switches for providing various combinations of hot and cold washing fluid and various timer switches operated by timer cams driven by the timer drive motor 79. The drive motor circuitry 76 also shown in block form comprises the drive motor start and run windings, speed switch, overload protector and various timer switches operated by timer cams driven by the timer drive motor 79.

The circuitry of FIG. 6 is arranged so that when the line switch 73 is closed but the lid 15 is open, the lid switch 59 will be in the non-conductive posture. A circuit will be completed by way of an internal timer bus connection 81 to the washing fluid fill circuitry 75 and if the washing fluid level switch 80 is made to the empty or fill contact 82, the circuit will be completed to conductor 72 of the power supply and the fabric washing machine 10 will fill with washing fluid with the lid 15 either open or closed. Energization of the drive motor circuitry 76 and energization of the timer drive motor 79 cannot occur until the washing fluid level switch is made to the full contact 83 as the fill is completed and the lid 15 is closed to actuate the lid switch 59 to the conductive posture and to actuate the switch 60 to the first conductive posture at contact 84.

During normal operation of the fabric washing machine 10, a cycle of operations can be interrupted at any point by merely opening the lid 15 to move the unbalance lever and lid switch actuator 36 in the forward direction to first actuate the lid switch 59 to the non-conductive posture. The act of opening the lid 15 will also normally actuate the switch 60 to the second conductive posture at contact 85 which, as shown in FIG. 6, bypasses the washing fluid fill circuitry 75 and is in series circuit connection with the fuse 70 and the empty or fill contact 82 of the washing fluid level switch 80. In the event that the lid switch 59 is welded or otherwise fixed in the closed posture when the lid 15 is opened with tub 21 empty, a circuit is completed from conductor 71, through the line switch 73, through the failed closed lid switch 59, through the switch 60 made to the second conductive posture at contact 85, through the fuse 70 and through the empty or fill contact 82 of the washing fluid level switch 80 to conductor 72. This will cause full line current to pass through the fuse 70 and will quickly destroy the fuse 70 to disable the fabric washing machine 10 and prevent the next fill of washing fluid.

If the lid switch 59 is welded and the lid 15 is opened during the cycle when the tub 21 is full of washing fluid and the full contact 83 of the washing fluid level switch 80 is made, a circuit to the fuse 70 will not be completed since the washing fluid level switch 80 is made to the full contact 83. In this case, the switch 60 will, in effect, act as a back-up lid switch and will interrupt the cycle of operations since power is discontinued to the drive motor circuitry 76 and timer drive motor 79. As further shown in FIG. 6, a cam actuated timer switch 86 is open during fill and closed during spin or washing fluid extraction portions of a cycle. Thus, a bypass circuit is provided around the washing fluid level switch 80 for independent operation of the drive motor circuitry 76 so that the drive motor circuitry 76 and timer drive motor 79 do not operate through the full contact 83.

The circuit through the fuse 70 can only be completed, in the preferred embodiment, when the washing fluid level switch 80 is made to the empty or fill contact 82 such as after a fluid extraction portion of a cycle and at the end of a cycle of operations. Then, when the lid 15 is opened with the lid switch 59 welded or failed in the conductive posture, the fuse 70 will be destroyed and the fabric washing machine 10 will be disabled. This disablement will require that the fabric washing machine 10 be serviced to replace the faulty lid switch 59 and the destroyed fuse 70.

During an unbalance situation where the bumper 53 has moved the unbalance lever and lid switch actuator 36 to the dashed line posture of FIG. 2, the lid switch 59 will be opened to the non-conductive posture but the switch 60 will remain in the first conductive posture at contact 84. The unbalance mechanism 25 is reset by opening and closing the lid 15 which will close the lid switch 59 to the conductive posture and allow the cycle of operations to continue.

Figure 7:
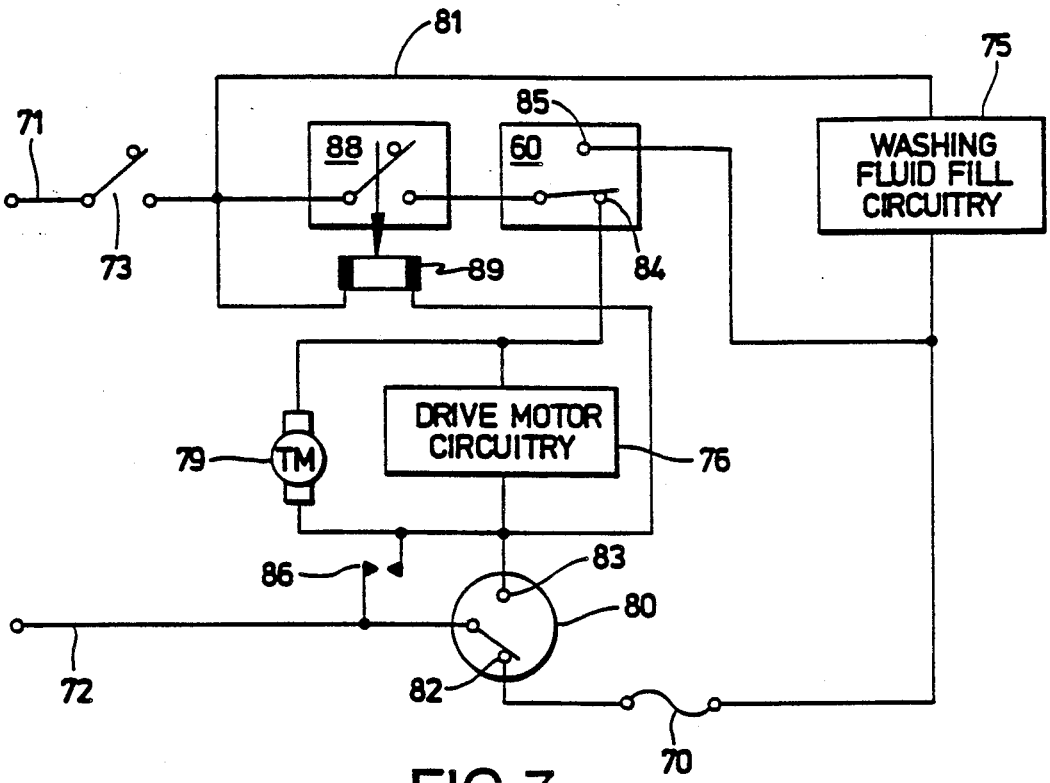
FIG. 7 is a schematic drawing of the operational circuitry of an alternate embodiment.

Referring now to FIG. 7, there is shown an alternate circuit embodiment. In this alternate embodiment, closing the line switch 73 with the control knob 74 will allow the fabric washing machine 10 to fill with the lid 15 either open or closed in a circuit similar to that shown in FIG. 6. Energization of the drive motor circuitry 76 and energization of the timer drive motor 79 cannot occur until the washing fluid level switch 80 is made to the full contact 83 as the fill is completed and the lid 15 is closed to operate the switch 60 to the lid-closed first conductive posture at contact 84. Once the fluid level switch 80 is made to the full contact 83, an electromechanical actuator such as a solenoid 89 is energized to close switch 88 which, in this embodiment, may be located away from the switch mounting bracket 40. A lid latching mechanism including a switch operating solenoid as in the alternate embodiment of FIG. 7 is fully described in U.S. Pat. No. 4,623,179 issued Nov. 18, 1986 to Davis et al and assigned to the assignee of the present invention. Closing switch 88 will complete a circuit to the drive motor circuitry 76 through switch 60 made to lid-closed contact 84 to permit operation of the fabric washing machine 10. It is anticipated, in the circuit of FIG. 7, that the solenoid 89 may be utilized to operate a lid latching mechanism as shown and described in U.S. Pat. No. 4,623,179 in addition to operating switch 88 to the conductive posture as the tub 21 is filled.

Once again, if switch 88 is welded or otherwise fixed in the closed posture with the lid 15 open and with tub 21 empty, a circuit will be completed as previously described for FIG. 6. Specifically, the circuit extends from conductor 71, through the line switch 73, through the switch 88, through the switch 60 made to the lid-open second conductive posture at contact 85, through the fuse 70 and through the empty or fill contact 82 of the washing fluid level switch 80 to conductor 72. This will again permit full line current to pass through fuse 70 for disabling the fabric washing machine 10 and preventing the next fill of washing fluid.

The control system as described herein provides for improved operation of a fabric washing machine. The control system provides for disablement of the fabric washing machine if the contacts of the lid switch are detected to be welded or otherwise fixed in the conductive posture and in response to a predetermined operational condition of the fabric washing machine. The control system is arranged so that the switch 60 will function as a back-up lid switch during the cycle of operations and the fabric washing machine will not be disabled with a full tub of washing fluid.

The control system of the preferred embodiment as described herein further provides for adjustment of the actuators of the lid switches relative to the unbalance lever and lid switch actuator. The switches are mounted in a stationary posture on the mounting bracket and the mounting bracket is adjustable with respect to the top cover and unbalance lever and lid switch actuator to position the mounting bracket and switches for proper actuation.

In the drawings and specification, there has been set forth a preferred embodiment of the invention and although specific terms are employed, these are used in a generic and descriptive sense only and not for purposes of limitation. Changes in the form and the proportion of parts as well as the substitution of equivalents are contemplated as circumstances may suggest or render expedient without departing from the spirit or scope of the invention as further defined in the following claims.

We claim:

1. A control system for a fabric washing machine having a movable lid for providing access to a tub assembly, comprising: power supply means; first switch means in circuit with said power supply means and operable between conductive and non-conductive postures; second switch means in circuit with said first switch means and operable between a lid-closed first conductive path and a lid-open second conductive path; means for operating said first and second switch means; third switch means responsive to a condition of operation of said fabric washing machine; and lockout means in circuit with said third switch means and said second conductive path of said second switch means for interrupting operation of said fabric washing washing machine and preventing reenergization thereof upon failure of said first switch means to operate to said non-conductive posture.

2. A control system for a fabric washing machine having a movable lid for providing access to a tub assembly, comprising: power supply means; first switch means in circuit with said power supply means and operable between conductive and non-conductive postures; second switch means in circuit with said first switch means and operable between a lid-closed first conductive path and a lid-open second conductive path; means for operating said first and second switch means; third switch means responsive to a condition of operation of said fabric washing machine; and lockout means in circuit with said third switch means and said second conductive path of said second switch means for interrupting operation of said fabric washing machine, said first and second switch means arranged so that opening of said lid sequentially operates said first switch means to said non-conductive posture and said second switch means to said second conductive path whereby failure of said first switch means to operate to said non-conductive posture completes a circuit to said lockout means for preventing reenergization of said fabric washing machine.

3. A control system as defined in claim 2 wherein said means for operating comprises a solenoid.

4. A control system as defined in claim 2 wherein said means for operating comprises said lid.

5. A control system for a fabric washing machine having a movable lid for providing access to a tub assembly, comprising: power supply means; first switch means in circuit with said power supply means and actuatable between conductive and non-conductive postures responsive to movement of said lid; second switch means in circuit with said first switch means and actuatable between a lid-closed first conductive path and a lid-open second conductive path responsive to movement of said lid; third switch means responsive to a condition of operation of said fabric washing machine; and lockout means in circuit with said third switch means and said second conductive path of said second switch means for interrupting operation of said fabric washing machine, said first and second switch means arranged so that opening of said lid sequentially actuates said first switch means to said non-conductive posture and said second switch means to said second conductive path whereby failure of said first switch means to actuate to said non-conductive posture completes a circuit to said lockout means for preventing reenergization of said fabric washing machine.

6. A control system as defined in claim 5 wherein said condition responsive third switch means includes means responsive to the level of washing fluid in said tub assembly.

7. A control system as defined in claim 5 and further including adjustable means for mounting said first and second switch means to said fabric washing machine, said first and second switch means each include an actuator and are mounted to said adjustable means in a spaced-apart relationship.

8. A control system as defined in claim 7 and still further including switch actuating means engageable with said lid and in juxtaposition to said actuators for actuating said first and second switch means responsive to movement of said lid, said adjustable means being selectively movable to provide concurrent movement of said first and second switch means to adjust said actuators relative to said switch actuating means.

9. A control system for a fabric washing machine having a movable lid for providing access to a tub assembly, comprising: power supply means; first lid switch means in circuit with said power supply means and actuatable between conductive and nonconductive postures responsive to movement of said lid; second lid switch means in circuit with said first lid switch means and actuatable between a lid-closed first conductive path and a lid-open second conductive path responsive to movement of said lid; fluid level control means including level detecting third switch means responsive to the washing fluid level in the tub assembly; and lockout means in circuit with said second conductive path of said second lid switch means and said level detecting third switch means for interrupting operation of said fabric washing machine, said first and second lid switch means arranged so that opening of said lid sequentially actuates said first lid switch means to said non-conductive posture and said second lid switch means to said second conductive path whereby failure of said first lid switch means to actuate to said non-conductive posture completes a circuit to said lockout means through said first and second lid switch means and said level detecting third switch means for preventing reenergization of said fabric washing machine.

10. A control system as defined in claim 9 and further including adjustable means for mounting said first and second lid switch means to said fabric washing machine, said first and second lid switch means each include an actuator and are mounted to said adjustable means in a spaced-apart relationship.

11. A control system as defined in claim 10 and still further including switch actuating means engageable with said lid and in juxtaposition to said actuators for actuating said first and second lid switch means responsive to movement of said lid, said adjustable means being selectively movable to provide concurrent movement of said first and second lid switch means to adjust said actuators relative to said switch actuating means.

12. A control system as defined in claim 9 wherein said level detecting third switch means includes a pressure switch operable between a fill contact and a full contact.

13. A control system as defined in claim 12 wherein said circuit to said lockout means is completed when said pressure switch is made to said fill contact.

14. A control system as defined in claim 9 wherein said lockout means includes a fuse.

15. A control system for a fabric washing machine having a movable lid for providing access to a tub assembly, comprising: power supply means; lid switch means in circuit with said power supply means and actuatable between conductive and non-conductive postures responsive to movement of said lid; auxiliary switch means in series with said lid switch means and actuatable between a lid-closed first conductive path and a lid-open second conductive path responsive to movement of said lid; washing fluid level control means including washing fluid inlet means and level detecting switch means responsive to the washing fluid level in the tub assembly for actuation between a fill contact in series with the lid-open second conductive path of said auxiliary switch means and a full contact; and lockout means in circuit with said second conductive path of said auxiliary switch means and said fill contact of said level detecting switch means for interrupting operation of said fabric washing machine, said lid and auxiliary switch means arranged so that opening of said lid sequentially actuates said lid switch means to said non-conductive posture and said auxiliary switch means to said second conductive path whereby failure of said lid switch means to actuate to said non-conductive posture upon opening of said lid and with said level detecting switch means actuated to said fill contact completes a circuit to said lockout means for preventing reenergization of said fabric washing machine.

16. A control system as defined in claim 15 and further including means for energizing and controlling said fabric washing machine with said lid switch means actuated to said conductive posture, said auxiliary switch means actuated to said first conductive path and said level detecting switch means actuated to said full contact.

17. A control system as defined in claim 15 wherein said lid and auxiliary switches are sequenced for actuation responsive to movement of said lid with said auxiliary switch means actuatable to said first conductive path before said lid switch means is actuated to said conductive path upon closing of said lid.

18. A control system for a fabric washing machine having an enclosure including a top cover with a movable lid providing access to a tub assembly and further including a circuit having a plurality of switches actuatable for controlling energization of said fabric washing machine, the combination comprising: switch mounting means adjustably secured to said top cover; first switch means mounted to said switch mounting means and including an actuator; second switch means mounted to said switch mounting means and including an actuator spaced from the actuator of said first switch means; and switch actuating means movably supported on said top cover and engageable with said lid and in operational proximity to the actuators of said first and second switch means with movement of said lid effecting movement of said switch actuating means to sequentially actuate said first and second switch means, said switch mounting means being selectively movable on said top cover to provide for concurrent movement of said first and second switch means to adjust said switch actuators relative to said switch actuating means.

19. A control system for a fabric washing machine having an enclosure including a top cover with a movable lid providing access to a tub assembly and further including a circuit having a plurality of switches actuatable for controlling energization of said fabric washing machine, the combination comprising: switch mounting means adjustably secured to said top cover; first switch means mounted to said switch mounting means and including an actuator; second switch means mounted to said switch mounting means and including an actuator spaced from and generally facing the actuator of said first switch means; and switch actuating means movably supported on said top cover and engageable with said lid and including a portion disposed between the actuators of said first and second switch means with movement of said lid effecting movement of said switch actuating means to sequentially actuate said first and second switch means, said switch mounting means being selectively movable on said top cover to provide for simultaneous movement of said first and second switch means for adjustment of the relative spacing of said switch actuators with respect to said portion of said switch actuating means between said actuators.

20. A control system as defined in claim 19 including adjustment means associated with said top cover and said switch mounting means whereby said switch mounting means is adjusted so that said first switch means is the last actuated as said lid is closed and the first actuated as said lid is opened.

21. A control system as defined in claim 19 and further including means operable responsive to an unbalance condition in said fabric washing machine for moving said portion of said switch actuating means out of engagement with said first switch means actuator to interrupt operation of said fabric washing machine, said switch mounting means including guide means for guiding said portion into engagement with said first switch means actuator upon resetting the unbalance condition.

22. A control system as defined in claim 19 and further including locking means cooperable with said top cover and said switch mounting means for locking said switch mounting means in a switch adjusted posture.

23. A control system as defined in claim 19 wherein said switch mounting means further includes means for mounting a fuse holder.

24. A control system for a fabric washing machine having an enclosure including a top cover with a movable lid for providing access to a tub assembly, comprising: switch mounting means adjustably secured to said top cover; first and second series connected switch means mounted on said switch mounting means; power supply means; said first switch means being in circuit with said power supply means and actuatable between conductive and non-conductive postures responsive to movement of said lid, said second switch means being spaced from said first switch means and actuatable between a lid-closed first conductive path and a lid-open second conductive path responsive to movement of said lid, said switch mounting means being selectively movable to provide for concurrent operational adjustment of said first and second switch means; third switch means responsive to a condition of operation of said fabric washing machine; and lockout means in series circuit with said second conductive path of said second switch means for interrupting operation of said fabric washing machine, said first and second switch means arranged so that opening of said lid sequentially actuates said first switch means to said non-conductive posture and said second switch means to said second conductive path whereby failure of said first switch means to actuate to said non-conductive posture completes a circuit to said lockout means for preventing reenergization of said fabric washing machine.

* * * * *